US009218922B2

(12) United States Patent
Luebke

(10) Patent No.: US 9,218,922 B2
(45) Date of Patent: Dec. 22, 2015

(54) FUSE ASSEMBLY INCLUDING CONTROLLED SEPARABLE CONTACTS AND POWER SYSTEM INCLUDING THE SAME

(71) Applicant: EATON CORPORATION, Cleveland, OH (US)

(72) Inventor: Charles John Luebke, Hartland, WI (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 256 days.

(21) Appl. No.: 13/926,031

(22) Filed: Jun. 25, 2013

(65) Prior Publication Data

US 2014/0376142 A1 Dec. 25, 2014

(51) Int. Cl.

| | |
|---|---|
| ***H01H 73/00*** | (2006.01) |
| ***H01H 9/10*** | (2006.01) |
| ***H01H 85/48*** | (2006.01) |
| *H01H 50/08* | (2006.01) |
| *H01H 85/30* | (2006.01) |

(52) U.S. Cl.

CPC ..... *H01H 9/10* (2013.01); *H01H 85/48* (2013.01); *H01H 50/08* (2013.01); *H01H 85/30* (2013.01)

(58) Field of Classification Search

CPC ..... H01H 9/104; H01H 9/10
USPC ..... 361/104, 115; 337/6
See application file for complete search history.

(56) References Cited

U.S. PATENT DOCUMENTS

| | | | | |
|---|---|---|---|---|
| 5,097,382 | A * | 3/1992 | Leach | H02B 11/127 361/615 |
| 6,717,505 | B1 * | 4/2004 | Bruchmann | H01H 85/32 337/187 |
| 7,474,194 | B2 * | 1/2009 | Darr | H01H 9/104 337/59 |
| 8,405,945 | B2 * | 3/2013 | DiMarco | H02H 3/08 361/104 |
| 8,614,618 | B2 * | 12/2013 | Darr | H01H 9/10 337/143 |
| 8,648,498 | B1 * | 2/2014 | West | H02J 3/383 307/82 |
| 2001/0033502 | A1 * | 10/2001 | Blair | H02J 7/0022 363/65 |
| 2011/0031813 | A1 * | 2/2011 | Falk | H02J 3/383 307/777 |
| 2011/0090607 | A1 * | 4/2011 | Luebke | H01L 31/02021 361/42 |
| 2011/0121984 | A1 * | 5/2011 | Schripsema | H01L 31/02021 340/635 |
| 2011/0141644 | A1 | 6/2011 | Hastings et al. | |
| 2011/0169599 | A1 * | 7/2011 | Darr | H01H 9/10 337/143 |
| 2011/0170223 | A1 * | 7/2011 | DiMarco | H02H 3/08 361/94 |
| 2011/0301772 | A1 | 12/2011 | Zuercher et al. | |
| 2012/0113554 | A1 | 5/2012 | Paoletti et al. | |
| 2013/0058013 | A1 * | 3/2013 | Cutler | H01H 31/12 361/626 |
| 2013/0133716 | A1 * | 5/2013 | Buettner | H01R 25/142 136/244 |
| 2013/0278375 | A1 * | 10/2013 | Henricks | H01H 85/041 337/186 |
| 2014/0091625 | A1 * | 4/2014 | Truettner | H02J 3/383 307/43 |

* cited by examiner

*Primary Examiner* — Stephen W Jackson
*Assistant Examiner* — Christopher Clark
(74) *Attorney, Agent, or Firm* — Armstrong Teasdale LLP

(57) ABSTRACT

A fuse assembly structured for use with a power circuit includes: a fuse holder defining a space and including first and second terminals structured to electrically connect to the power circuit; a fuse disposed in the space defined by the fuse holder; and a relay disposed in the space defined by the fuse holder. The relay includes separable contacts, an operating mechanism structured to open and close said separable contacts, and a control circuit cooperating with said operating mechanism to cause said operating mechanism to open or close said separable contacts. Current flowing between the first and second terminals flows through the separable contacts and the fuse and opening the separable contacts interrupts said current flowing between said first and second terminals.

20 Claims, 5 Drawing Sheets

FUSE ASSEMBLY INCLUDING CONTROLLED SEPARABLE CONTACTS AND POWER SYSTEM INCLUDING THE SAME

BACKGROUND

1. Field

The disclosed concept relates generally to fuses and, more particularly, to fuse assemblies. The disclosed concept also relates to strings including fuse assemblies.

2. Background Information

Fuses have been used in photovoltaic systems to protect strings from over-current conditions. One type of fuse includes a conductive element which is electrically connected in series with a protected power circuit. The conductive element heats up due to current flowing therethrough. The fuse is designed such that when the current flowing through the power circuit exceeds a predetermined level, the conductive element becomes hot enough to melt and interrupt the current flowing through the power circuit.

However, fuses in photovoltaic systems are limited to protecting strings from over-current conditions, and cannot protect strings from other faults such as, for example and without limitation, reverse current conditions. It would be beneficial to provide additional protection for strings.

There is room for improvement in fuse assemblies.

There is also room for improvement in strings.

SUMMARY

These needs and others are met by aspects of the disclosed concept which provide a fuse assembly including a relay. These needs and others are also met by aspects of the disclosed concept which provide a string including a fuse assembly including a relay.

In accordance with aspects of the disclosed concept, a fuse assembly structured for use with a power circuit comprises: a fuse holder defining a space and including first and second terminals structured to electrically connect to the power circuit; a fuse disposed in the space defined by the fuse holder; and a relay electrically connected in series with the fuse, the relay disposed in the space defined by the fuse holder and including separable contacts, an operating mechanism structured to open and close the separable contacts, and a control circuit cooperating with the operating mechanism to cause the operating mechanism to open or close the separable contacts, wherein current flowing between the first and second terminals flows through the separable contacts and the fuse, and wherein opening the separable contacts or the fuse interrupts the current flowing between the first and second terminals.

In accordance with other aspects of the disclosed concept, a string having a feed end and a remote end comprises: a plurality of direct current electrical generating modules electrically connected in series; a power line electrically connected between the feed end and one of the direct current electrical generating modules or between two of the direct current electrical generating modules; a return line electrically connected to one of the direct current electrical generating modules at the remote end; and a number of string protectors in the power line or return line of the string, each of the number of string protectors comprising: a fuse holder defining a space and including first and second terminals structured to electrically connect to the power line or the return line; a fuse disposed in the space defined by the fuse holder; and a relay electrically connected in series with the fuse, the relay disposed in the space defined by the fuse holder and including separable contacts, an operating mechanism structured to open and close the separable contacts, and a control circuit cooperating with the operating mechanism to cause the operating mechanism to open or close the separable contacts, wherein current flowing between the first and second terminals flows through the separable contacts and the fuse, and wherein opening the separable contacts or the fuse interrupts the current flowing between the first and second terminals.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
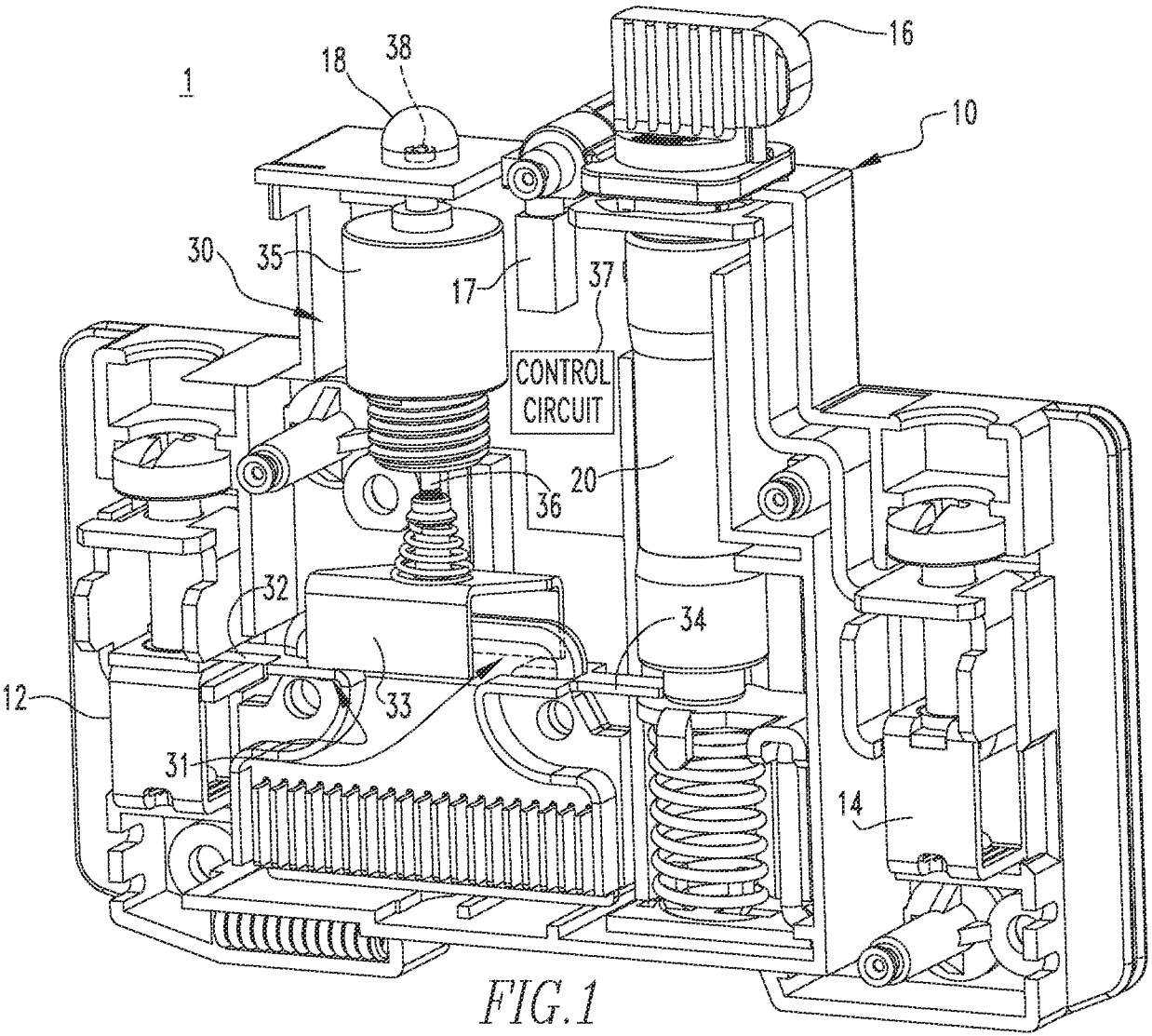
FIG. 1 is an isometric view of a fuse assembly with separable contacts in a closed position in accordance with an example embodiment of the disclosed concept.

Directional phrases used herein, such as, for example, left, right, front, back, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

As employed herein, the term "string" shall mean a series electrical circuit connection of a plurality of electrical generating modules.

As employed herein, the term "string protector" shall mean a protection device for a string and/or an electrical generating module of a string. The string protector includes a number of arc fault circuit interrupter (AFCI), over current, reverse current, feed forward fault, ground fault protection and/or remote shutdown functions.

As employed herein, the term "combiner box" shall mean a box, an enclosure or another suitable structure where one or both ends of a plurality of strings are fused and/or protected. A combiner box electrically combines in parallel DC current from several strings.

As employed herein, the term "direct current electrical generating module" shall mean a photovoltaic (PV) electrical generating module, a battery or a fuel cell.

As employed herein, the term "power line" shall mean a power conductor at the feed end of a string or between PV modules.

As employed herein, the term "return line" shall mean a power conductor extending from the remote end to the feed end of a string.

As employed herein, the term "feed forward fault" shall mean a fault defined by a non-zero forward current and a corresponding voltage that is significantly lower than Voc (e.g., without limitation, a voltage less than about 20% of open circuit voltage) or Vmpp (voltage at the maximum power point). For example, a feed forward fault can indicate an external short toward the feed (inverter) end of a string.

The disclosed concept is described in association with protection for PV circuits, although the disclosed concept is applicable to a wide range of DC applications, including for example and without limitation, relatively higher DC voltage circuits, such as wind power, hybrid vehicles, electric vehicles, marine systems and aircraft.

Referring to FIG. 1, a fuse assembly 1 includes a fuse holder 10. The fuse holder 10 defines an interior space of the fuse assembly 1. The fuse holder 10 also includes first and second terminals 12,14. The first and second terminals 12,14 are configured to electrically connect to a power circuit such as, for example and without limitation, a power line 6 of a power system 2 (see FIG. 3).

The fuse assembly 1 further includes a fuse 20 and a relay 30 electrically connected in series between the first and second terminals 12,14. Current flowing between the first and second terminals 12,14 flows through the fuse 20 and the relay 30. Both the fuse 20 and the relay 30 are also capable of interrupting the current flowing between the first and second terminals 12,14.

Figure 2:
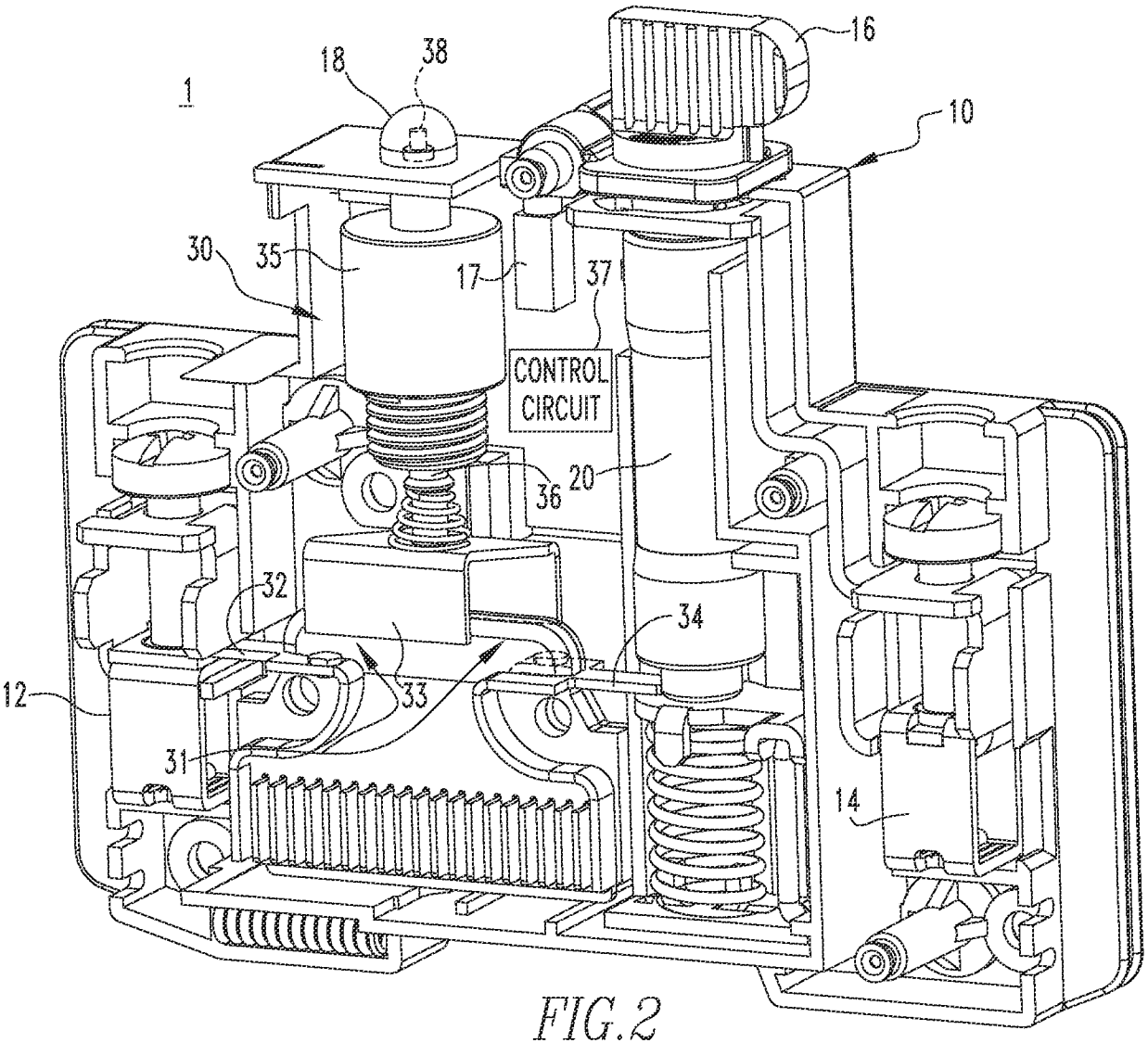
FIG. 2 is an isometric view of the fuse assembly of FIG. 1 except with the separable contacts in an open position.

The relay 30 includes separable contacts 31 which, when closed, allow current to flow between the first and second terminals 12,14, and when open, interrupt the current flowing between the first and second terminals 12,14. The separable contacts 31 include a first conductor 32, a second conductor 33, and a third conductor 34. The first and third conductors 32,34 have a fixed position and the second conductor 33 is moveable between a closed position (as shown in FIG. 1) in which the second conductor 33 is in electrical contact with both the first and third conductors 32,34 and allows current to flow between the first and third conductors 32,34, and an open position (as shown in FIG. 2) in which the second conductor 33 is not in electrical contact with the first and third conductors 32,34 and does not allow current to flow between the first and third conductors 32,34.

The separable contacts 31 are opened and closed with an operating mechanism such as the example solenoid 35. The solenoid 35 includes an actuator 36 that is coupled with the separable contacts 31 and, in particular, the second conductor 33, which is movable. Operation attic solenoid 35 moves the actuator 36 to open or close the separable contacts 31. The solenoid 35 may be biased to hold the separable contacts 31 open when no power is provided to the solenoid 35. However, it should be appreciated that the solenoid 35 may also be biased to hold the separable contacts 31 closed when no power is provided to the solenoid 35 without departing from the scope of the disclosed concept.

The relay 30 further includes a control circuit 37 which is configured to control operation of the solenoid 35. The control circuit 37 may receive an external control signal such as a control signal from a fault detector 60 (see FIG. 3) or an external remote control signal from external control equipment. The control circuit 37 controls operation of the solenoid 35 based on the received control signal. The control circuit 37 may also monitor a characteristic attic power circuit (e.g., without limitation, current; voltage; or any other suitable characteristic) and control operation of the solenoid 35 based on the monitored characteristic. For example and without limitation, a fault detector 60 may be integrated into the control circuit 37' (see FIG. 4).

The fuse holder 10 further includes a fuse access mechanism 16 which can be opened to provide access to the fuse 20 to, for example and without limitation, replace the fuse 20. However, accessing the fuse 20 when current is flowing between the first and second terminals 12,14 can create a dangerous situation. To this end, opening the fuse access mechanism 16 actuates a manual switch 17, which in turn causes the control circuit 37 to operate the solenoid 35 to open the separable contacts 31 and interrupt the current flowing between the first and second terminals 12,14. Closing the fuse access mechanism 16 actuates the manual switch 17 again causing the control circuit 37 to operate the solenoid 35 to close the separable contacts 31. The fuse holder 10 may also be structured so that a user can directly access and manually actuate the manual switch 17.

The solenoid 35 may also include an indicator 38. The indicator 38 is structured to remain inside the interior space of the fuse holder 10 when the separable contacts 31 are closed, as shown in FIG. 1, and to extend outside the interior space of the fuse holder 10 when the separable contacts 31 are open, as shown in FIG. 2. The indicator 38 is visible from outside of the fuse holder 10 which allows a user to determine whether the separable contacts 31 are open or closed without accessing the interior space of the fuse holder 10. It should be appreciated that any suitable indicator visible from outside the fuse holder 10 (e.g., without limitation, a light; a light emitting diode; or any other suitable indicator) may be employed in the fuse assembly 1 without departing from the scope of the disclosed concept. The fuse holder 10 may also include a transparent indicator shield 18 which covers the indicator 38 and is disposed outside the interior space of the fuse holder 10. The transparent indicator shield 18 protects the indicator 38 from being tampered with while still allowing the indicator 38 to be viewed.

Figure 3:
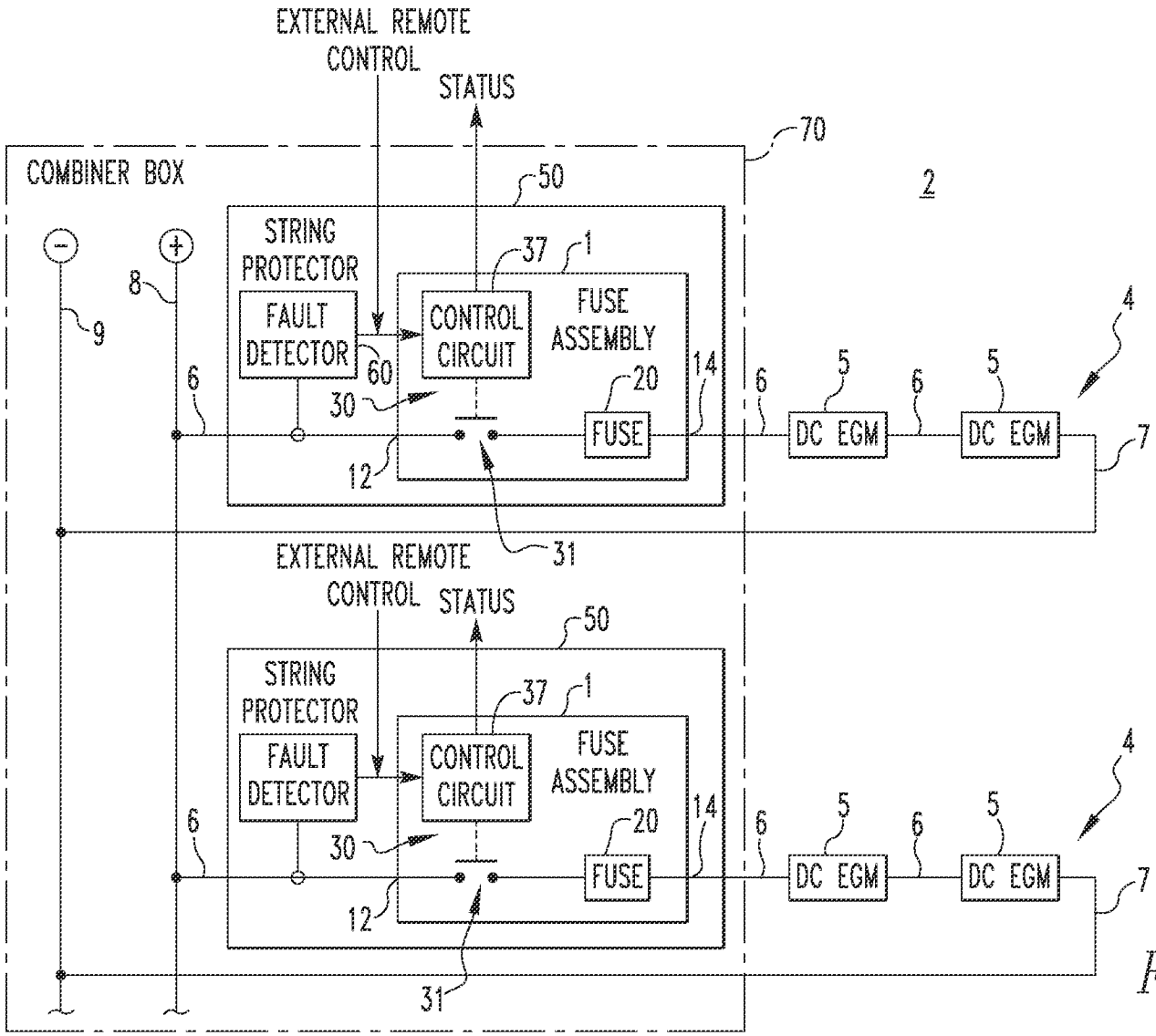
FIG. 3 is a block diagram of a system including a plurality of strings of direct current electrical generating modules (DC EGMs) and a plurality of string protectors in accordance with an embodiment of the disclosed concept.
Figure 4:
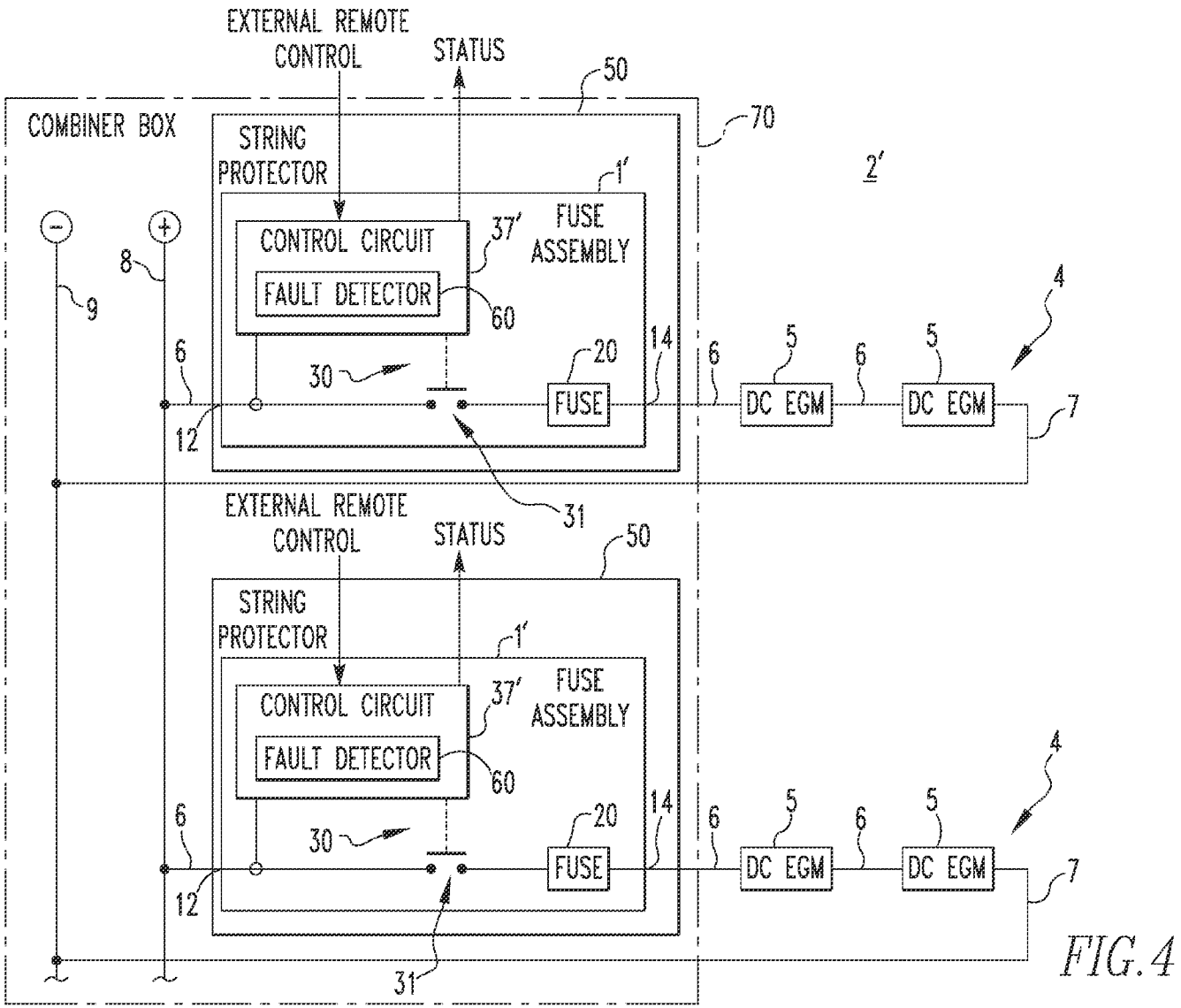
FIG. 4 is a block diagram of a system including a plurality of strings of DC EGMs and a plurality of string protectors in accordance with another example embodiment of the disclosed concept.
Figure 5:
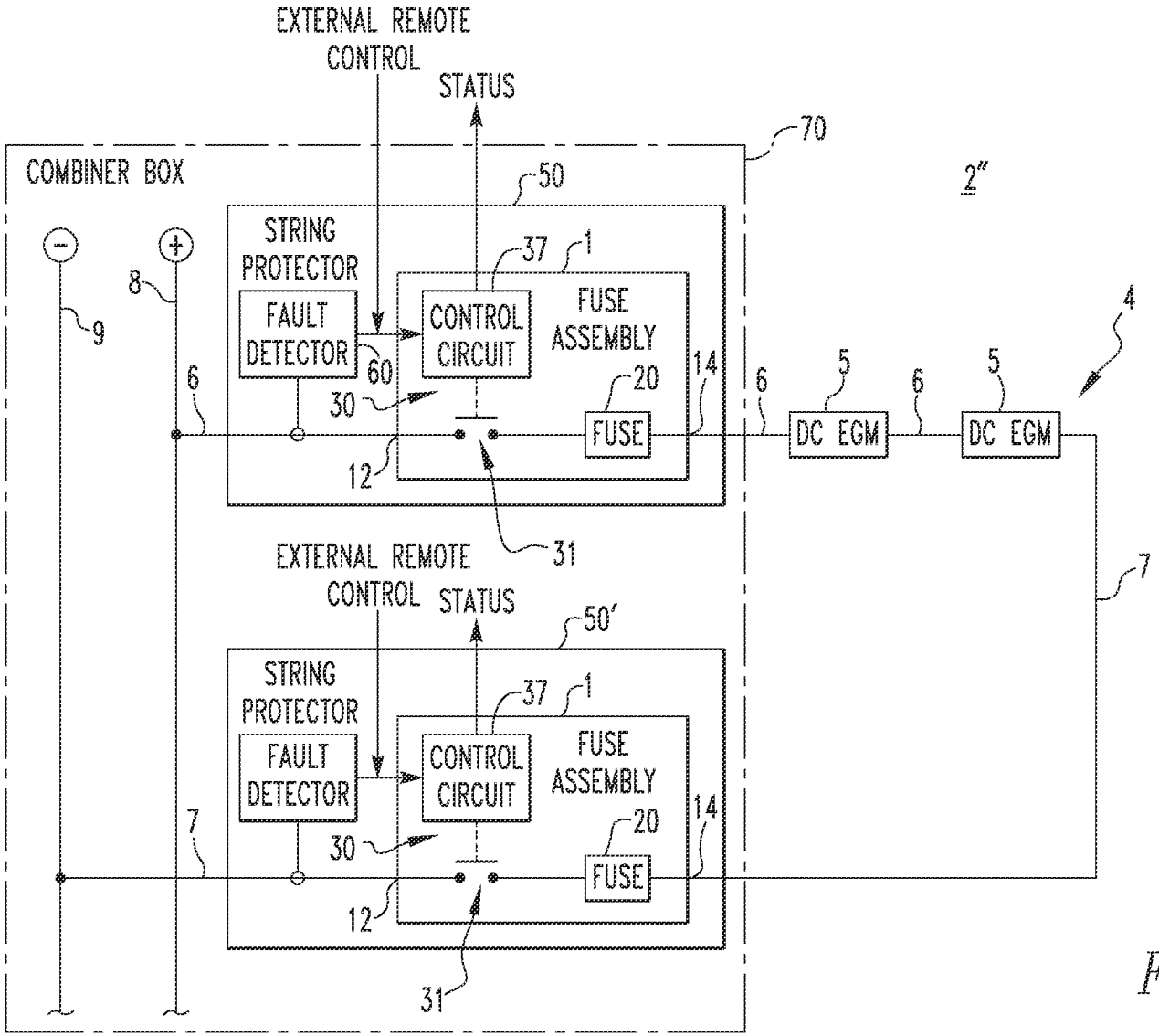
FIG. 5 is a block diagram of a system including a string of DC EGMs and a plurality of string protectors in accordance with another example embodiment of the disclosed concept.

The fuse assembly 1 may be employed as part of a power system such as the power systems 2, 2', and 2" shown in respective FIGS. 3, 4, and 5. Referring to FIG. 3, the power system 2 includes a plurality of strings 4 of direct current electrical generating modules 5 (DC EGMs) (e.g., without limitation, PV modules). While strings 4 including two DC EGMs 5 are disclosed, it should be appreciated that any suitable number of DC EGMs 5 can be employed with each of the strings 4 without departing from the scope of the disclosed concept. Each of the strings 4 includes power lines 6 electrically connected between the feed end of the string 4 and one of the DC EGMs 5 or between two of the DC EGMs 5. Each of the strings 4 also includes a return line 7 electrically connected to one of the DC EGMs 5 at a remote end of the string 4. One of the power lines 6 is also electrically connected to a positive bus 8 and the return line 7 is electrically connected to a negative bus 9 in a combiner box 70 at the feed end of the string 4.

Each of the strings 4 further includes a string protector 50 in one of the power lines 6. The string protector 50 includes a fuse assembly, such as the fuse assembly 1 of FIG. 1, and a fault detector 60. The fuse assembly 1 is electrically connected to one of the power lines 6 by the first and second terminals 12,14, and current flowing through the power line 6 flows through the fuse 20 and separable contacts 31 of the fuse assembly 1. Removing or blowing the fuse 20, or opening the separable contacts 31, will interrupt the power flowing through the power line 6. The string protector 50 may be powered by an external or internal power source (not shown).

The internal power source may use power from the power line 6 to power the string protector 50.

The fault detector 60 monitors characteristics of the power line 6 and/or the return line 7 through one or more sensors, such as the example current sensors, in order to detect a number of faults of the string 4. The fault detector 60 also outputs a control signal to the control circuit 37 in order to control the control circuit 37 to cooperate with the solenoid 35 (see FIG. 1) to open the separable contacts 31 when a fault is detected. The fault detector 60 in combination with the fuse assembly 1 can provide arc fault protection, ground fault protection, reverse current protection, over-current protection, and/or feed forward fault protection. External remote control equipment (not shown) can also provide an external remote control signal to the control circuit 37 in order to control the control circuit 37 to cooperate with the solenoid 35 to open the separable contacts 31 under control of the external remote control equipment.

The fault detector 60 may also be integrated into the control circuit 37' of the fuse assembly 1', as shown in FIG. 4. When the fault detector 60 is integrated into the control circuit 37', the control circuit 37' monitors characteristics of the power line 6 and the return line 7 and does not need to rely on an external control signal to determine when to cooperate with the solenoid 35 (see FIG. 1) to open the separable contacts 31.

Any number of string protectors 50 may be employed on a string 4 without departing from the scope of the disclosed concept. Referring to FIG. 5, the string 4 includes first and second string protectors 50,50'. The first string protector 50 is in the power line 6 and the second string protector 50' is in the return line 7. In the event of a fault that causes one of the first and second string protectors 50,50' to open (i.e., the separable contacts 31 are opened) and interrupt current flowing in one of the power line 6 and the return line 7, a remote control signal may be used to cause the other of the first and second string protectors 50,50' to open and interrupt current flowing in the other of the power line 6 and the return line 7. Opening both the first and second string protectors 50,50' removes current flow or voltage potential that may be present and could potentially cause a shock hazard or arc fault when current is interrupted in only one of the power line 6 or the return line 7. It should also be appreciated that the first and second string protectors 50,50' may also operate independently of each other or a mechanical interlock (not shown) may be used to cause both of the first and second string protectors 50,50' to operate in conjunction with each other.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A fuse assembly comprising:

a fuse holder defining a first interior space configured to accept and enclose a cylindrical fuse;

a fuse access mechanism coupled to the fuse holder and selectively positionable between a first position providing access to the first interior space and a second position rendering the first interior space inaccessible;

first and second terminals in the fuse holder;

separable contacts in the fuse holder and including a pair of fixed position conductors and a movable conductor positionable relative to the pair of fixed position conductors between a closed position wherein electrical current may flow through the separable contacts and an opened position wherein electrical current is interrupted through the separable contacts;

an operating mechanism structured to position the movable conductor between the opened and closed positions;

a control circuit cooperating with the operating mechanism to cause the movable conductor to assume one of the opened and closed positions; and a manual switch associated with the control circuit;

wherein at least one of the selective positioning of the fuse access mechanism or operation of the manual switch causes the control circuit to reposition the movable conductor.

2. The fuse assembly of claim 1, wherein the operating mechanism comprises a solenoid attached to the movable conductor.

3. The fuse assembly of claim 1, further comprising an indicator that is visible from an exterior of the fuse holder when the movable conductor is in the opened position.

4. The fuse assembly of claim 3, further comprising a transparent protective shield coupled to the fuse holder proximate the fuse access mechanism, the indicator being visible within the transparent protective shield.

5. The fuse assembly of claim 3, wherein the indicator is movable relative to the fuse holder from a first position inside the fuse holder to a second position projecting from the fuse holder.

6. The fuse assembly of claim 1, wherein the selective positioning of the fuse access mechanism causes operation of the manual switch, and operation of the manual switch causes the control circuit to cooperate with the operating mechanism to position the movable conductor to the opened position.

7. The fuse assembly of claim 1, wherein the control circuit is structured to receive an external control signal, and the operating mechanism positions the movable conductor in response to the external control signal.

8. The fuse assembly of claim 1, wherein the control circuit is structured to monitor at least one characteristic of a power circuit and to cooperate with said operating mechanism to cause said operating mechanism to position the movable conductor based on the at least one monitored characteristic of the power circuit.

9. The fuse assembly of claim 1, wherein the movable conductor is biased to one of the opened and closed positions.

10. A power system comprising:

a string including a plurality of direct current electrical generating modules electrically connected in series between a feed end and a remote end;

a power line electrically connected between the feed end and one of the plurality of direct current electrical generating modules or between two of the plurality of current electrical generating modules;

a return line electrically connected to the remote end; and a number of string protectors in the power line or return line, each of the number of string protectors comprising:

a fuse holder defining a first interior space configured to accept and enclose a cylindrical fuse;

a fuse access mechanism coupled to the fuse holder and selectively positionable between a first position providing access to the first interior space and a second position rendering the first interior space inaccessible;

first and second terminals in the fuse holder;

separable contacts in the fuse holder and including a pair of fixed position conductors and a movable conductor positionable relative to the pair of fixed position conductors between a closed position wherein electrical current may flow through the separable contacts and an opened position wherein electrical current is interrupted through the separable contacts;

an operating mechanism structured to position the movable conductor between the opened and closed positions;

a control circuit cooperating with the operating mechanism to cause the movable conductor to assume one of the opened and closed positions;

and a manual switch associated with the control circuit;

wherein at least one of the selective positioning of the fuse access mechanism or operation of the manual switch causes the control circuit to reposition the movable conductor.

11. The power system of claim 10, wherein the operating mechanism comprises a solenoid attached to the movable conductor.

12. The power system of claim 10, further comprising an indicator that is visible from an exterior of the fuse holder when the separable contacts are in the opened position.

13. The power system of claim 12, further comprising a transparent protective shield coupled to the fuse holder proximate the fuse access mechanism, the indicator being visible within the transparent protective shield.

14. The power system of claim 13, wherein the indicator is movable relative to the fuse holder from a first position inside the fuse holder to a second position projecting from the fuse holder.

15. The power system of claim 10, wherein at least one of the number of string protectors further includes a fault detector structured to monitor at least one characteristic of the power line; and wherein the control circuit is configured to receive a control signal from the fault detector and cause the operating mechanism to reposition the movable conductor based on the received control signal.

16. The power system of claim 10, wherein the control circuit includes a fault detector structured to monitor at least one characteristic of the power line; and wherein the control circuit is structured to cooperate with said operating mechanism to cause said operating mechanism to reposition the movable conductor based on the at least one monitored characteristic of the power circuit.

17. The power system of claim 10, wherein the movable conductor is biased to one of the open position and the closed position when no power is applied to the operating mechanism.

18. The power system of claim 10, wherein the number of string protectors includes a first string protector and a second string protector; wherein the first string protector is in the power line; and wherein the second string protector is in the return line.

19. The power system of claim 18, wherein when the movable conductor in one of the first string protector and the second string protector is moved to the opened position, a remote control signal causes the movable conductor in the other of the first string protector and the second string protector to move to the opened position.

20. A fuse assembly comprising:

a fuse holder defining a first interior space configured to accept and enclose a cylindrical fuse;

a fuse access mechanism coupled to the fuse holder and selectively positionable between a first position providing access to the first interior space and a second position rendering the first interior space inaccessible;

separable contacts in the fuse holder and including a pair of fixed position conductors and a movable conductor positionable relative to the pair of fixed position conductors between a closed position wherein electrical current may flow through the separable contacts and an opened position wherein electrical current is interrupted through the separable contacts;

an operating mechanism structured to position the movable conductor between the opened and closed positions;

a control circuit cooperating with the operating mechanism to cause the movable conductor to assume one of the opened and closed positions;

wherein the selective positioning of the fuse access mechanism causes the control circuit to reposition the movable conductor.

* * * * *